US006745410B2

(12) United States Patent
Ford

(10) Patent No.: US 6,745,410 B2
(45) Date of Patent: Jun. 8, 2004

(54) COMMODE SEAT

(75) Inventor: Kerry John Ford, Carine (AU)

(73) Assignee: KDB Engineering Pty. Ltd., Malaga (AU)

( * ) Notice: Subject to any disclaimer, the term of this patent is extended or adjusted under 35 U.S.C. 154(b) by 0 days.

(21) Appl. No.: 10/277,789

(22) Filed: Oct. 23, 2002

(65) Prior Publication Data

US 2004/0078883 A1 Apr. 29, 2004

(51) Int. Cl.[7] ..... A47K 11/04
(52) U.S. Cl. ..... 4/483
(58) Field of Search ..... 4/480, 483

(56) References Cited

U.S. PATENT DOCUMENTS

| | | | | |
|---|---|---|---|---|
| 1,416,177 A | | 5/1922 | Dick et al. | |
| 1,648,791 A | | 11/1927 | Switzer | |
| 1,951,621 A | | 4/1934 | Mayette | |
| 1,953,855 A | | 4/1934 | Headworth et al. | |
| 3,950,794 A | | 4/1976 | Dalton | |
| 4,550,455 A | * | 11/1985 | Carson et al. | 4/480 |
| 4,790,039 A | | 12/1988 | Speer | |
| 4,962,551 A | | 10/1990 | Bly | |

FOREIGN PATENT DOCUMENTS

| | | |
|---|---|---|
| AU | 17880/24 | 5/1924 |
| AU | 8107/46 | 5/1947 |
| AU | 57765/60 | 8/1960 |
| AU | 49353/59 | 12/1960 |
| AU | 714750 | 12/1997 |
| AU | 95911 S | 5/2002 |
| DE | 808629 | 7/1951 |
| FR | 1312522 | 11/1961 |
| GB | 602674 | 6/1948 |
| JP | 07-327866 | 12/1995 |

OTHER PUBLICATIONS

Invacare Leaflet, revised Jun. 1990.

* cited by examiner

*Primary Examiner*—Charles E. Phillips
(74) *Attorney, Agent, or Firm*—Harness, Dickey & Pierce, P.L.C.

(57) ABSTRACT

The commode includes a commode frame and a commode seat adapted to be removably attached to the commode frame. The commode frame includes two spaced frame elements. The commode seat includes a seat body having an underside adapted to bear on the commode frame and a pair of spaced apart elongate members on the underside. The pair of spaced apart elongate members are adapted to co-operatively engage the two frame elements of the commode frame. The elongate members also defines rails adapted to slidingly receive and releasably support a receptacle beneath a seat.

9 Claims, 9 Drawing Sheets

COMMODE SEAT

FIELD OF THE INVENTION

This invention relates to a commode seat adapted to be detachably attached to a commode frame structure, and also to a commode having such a seat.

BACKGROUND ART

Commodes are often used when providing care and assistance to aged and disabled patients.

Commodes generally comprise a frame structure and a seat supported on the frame structure. In some cases, the commode seat is detachable from the frame structure to facilitate cleaning and maintenance of hygiene, as well as for ease of maintenance and seat exchange where necessary.

Because commodes are used by the infirm, there is a need for the seats to be securely attached to the commode frames. Commonly, mechanical fasteners such as screws are used for such a purpose. However, detachment of the seat can be cumbersome in cases where mechanical fasteners are used.

One proposal providing a commode seat which is readily detachable from a commode frame is disclosed in the applicant's Australian patent 714750. The patent discloses a commode seat having a coupling means which is operable with a snap engagement action and which has proved to be very effective in use.

With commodes, there can also be a need for a receptacle positioned below the commode seat, particularly where commodes are intended for use as a toilet. This introduces a requirement for a mechanism to removably support the receptacle below the commode seat.

It would be advantageous to provide a commode seat having means for detachably attaching the seat to a commode frame, in which such means also has provision for removably supporting a receptacle below the commode seat.

DISCLOSURE OF THE INVENTION

According to a first aspect of the invention there is provided a commode seat for removable attachment to a commode frame, the commode seat comprising a seat body having an underside adapted to bear on the commode frame and a pair of spaced apart elongate members on the underside, the pair of spaced apart elongate members being adapted to co-operatively engage two spaced apart frame elements of the commode frame for detachably attaching the commode seat to the commode frame, the elongate members also defining rails adapted to slidingly receive and releasably support a receptacle beneath the seat.

Preferably, the rails each have a locating portion at one end section thereof upon which a leading portion of the receptacle can be located prior to the receptacle being moved along the rails. The locating portion may have an upstanding lip at the outer end thereof.

Preferably, at least one elongate member is resilient to provide a releasable snap engagement with the respective commode frame element. More preferably, both elongate members are resilient.

Each elongate member may comprise a first portion and a second portion, the first portion extending downwardly from the underside of the seat for engagement against the respective frame element of the commode frame, and the second portion extending laterally to define the respective rail.

Each first portion may be configured to conform to the profile of the respective commode frame element to which it is adapted for engagement. Where the commode frame element is of circular cross-section as is typically the case, the first portion may incorporate a concave section to conform to the circular profile of the commode frame element.

Preferably, the second portions extend laterally in an inward direction towards each other.

Preferably, the second portion of each elongate member extends beyond the concave section at one end of the elongate member to define the locating portion at the end of the rail.

According to a second aspect of the invention there is provided a commode having a commode seat as defined above.

According to a third aspect of the invention there is provided a commode comprising a commode frame and a commode seat adapted to be removably attached to the commode frame, the commode frame including two spaced frame elements, and the commode seat comprising a seat body having an underside adapted to bear on the commode frame and a pair of spaced apart elongate members on the underside, the pair of spaced apart elongate members being adapted to co-operatively engage the two frame elements of the commode frame for removably attaching the commode seat to the commode frame, the elongate members also defining rails adapted to slidingly receive and releasably support a receptacle beneath the seat.

Preferably, the commode is a shower commode.

BRIEF DESCRIPTION OF THE DRAWINGS

The invention will be better understood by reference to the following description of one specific embodiment thereof as shown in the accompanying drawings in which.

BEST MODE(S) FOR CARRYING OUT THE INVENTION

Figure 1:
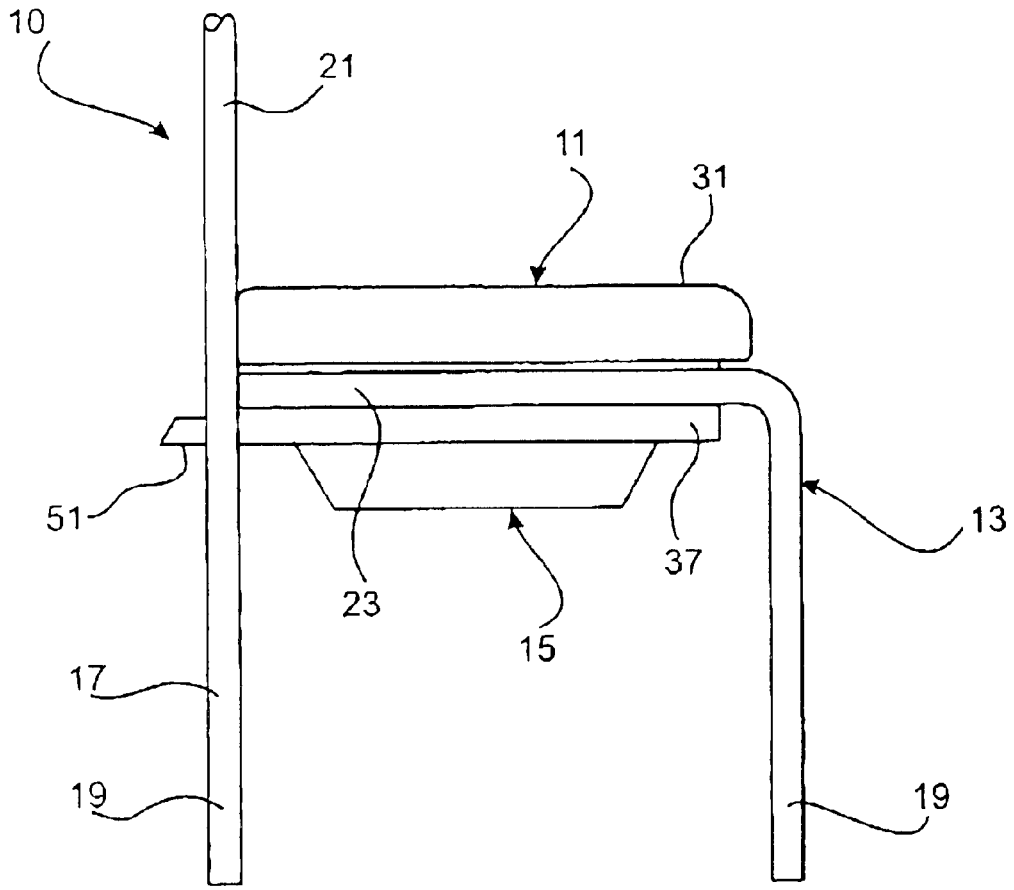
FIG. 1 is a schematic fragmentary side view of a commode according to the embodiment, the commode having a commode seat and a removable receptacle positioned beneath the commode seat.
Figure 2:
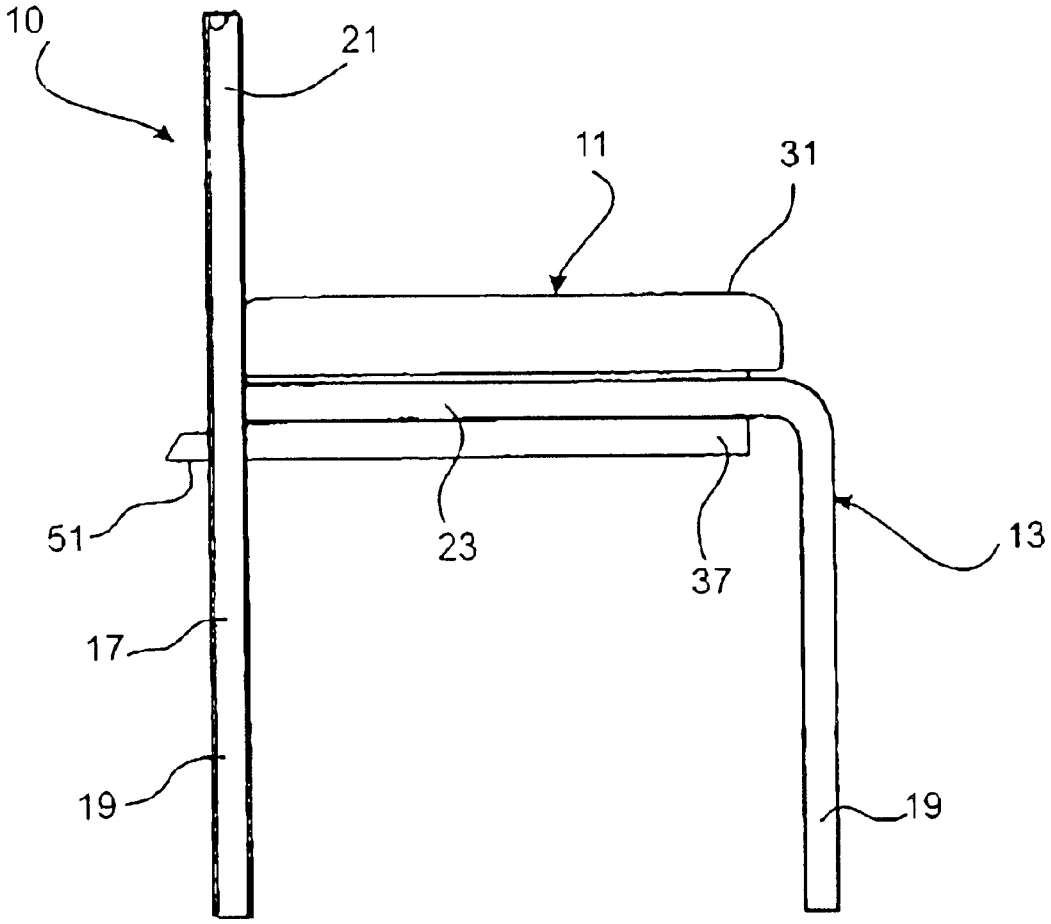
FIG. 2 is a view similar to FIG. 1, with the exception that the receptacle has been removed.

Referring to the drawings, there is shown a commode 10 according to the embodiment. The commode 10 includes a commode seat 11 and a commode frame 13. The commode 10 also includes a receptacle 15 adapted to be removably received beneath the commode seat 11.

Figure 3:
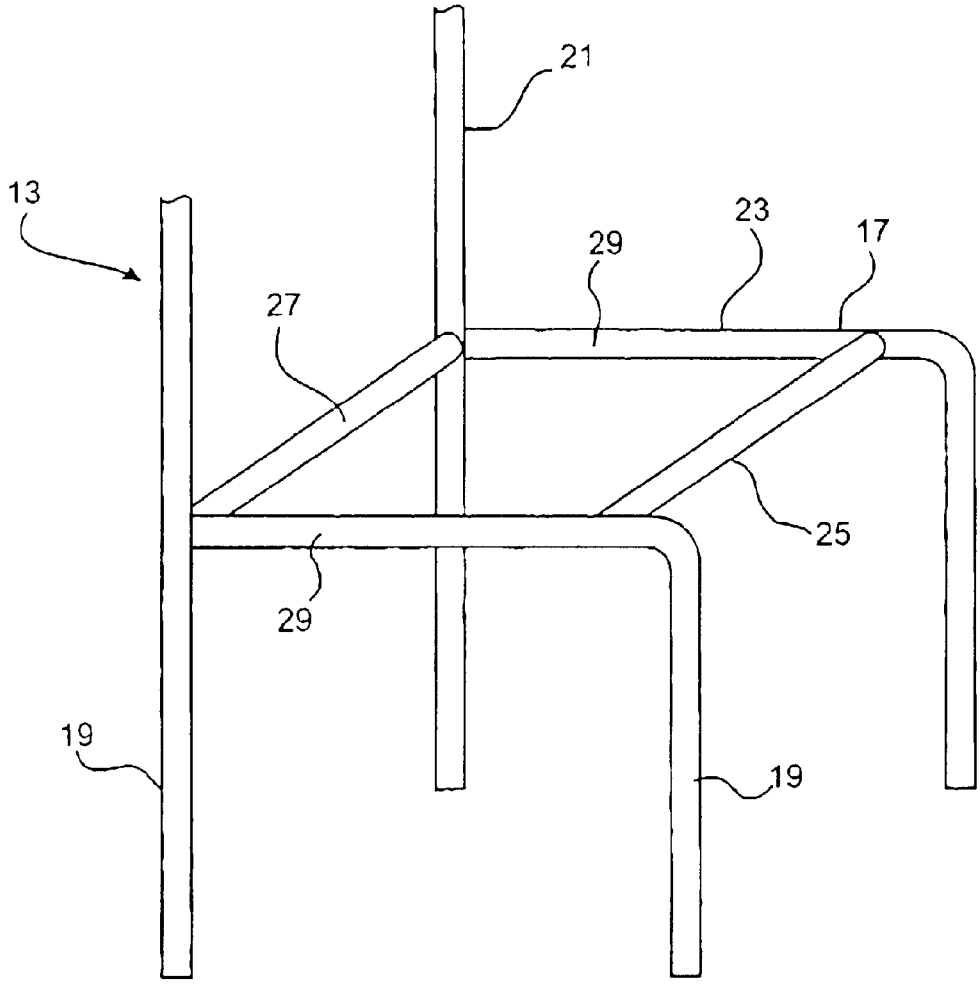
FIG. 3 is a schematic perspective view of the commode frame.
Figure 4:
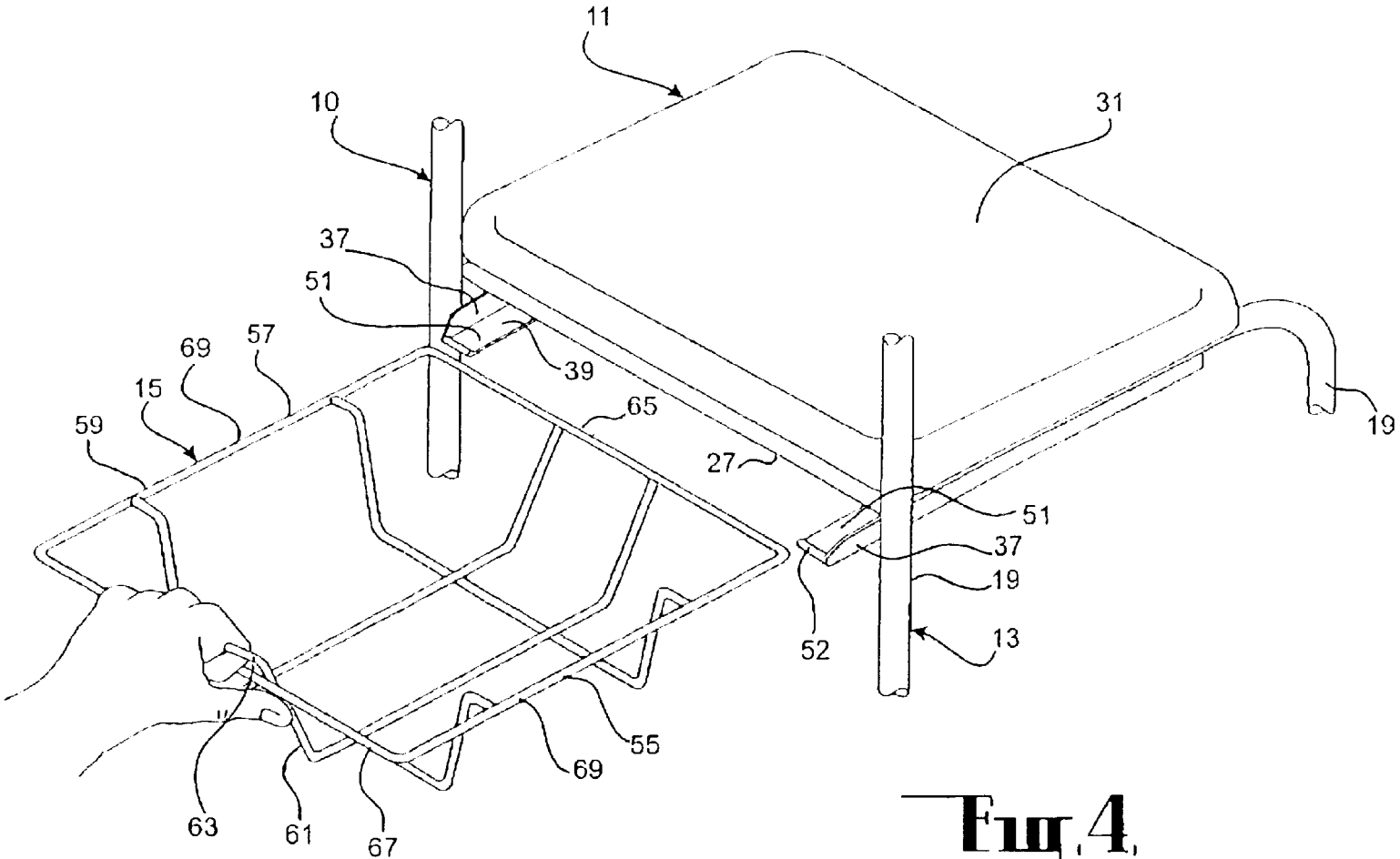
FIG. 4 is a fragmentary view illustrating the commode seat and the receptacle removed from beneath the commode seat.
Figure 5:
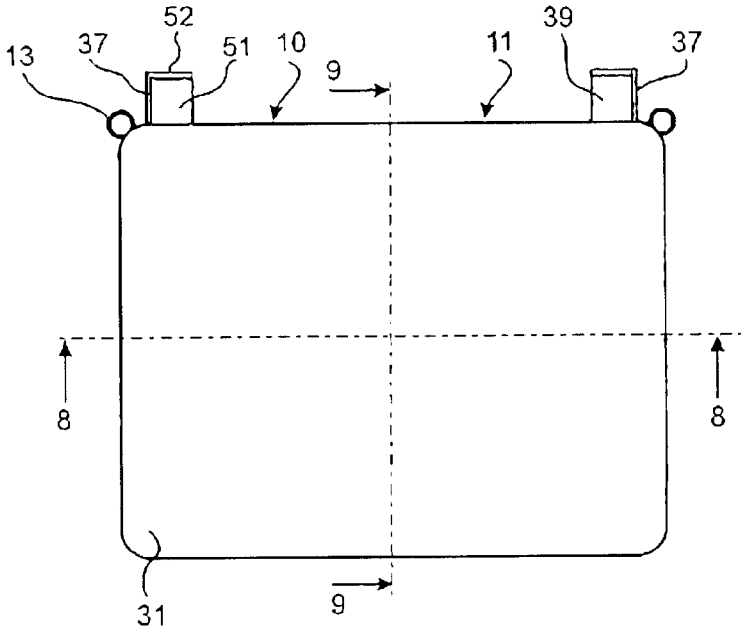
FIG. 5 is a plan view of the commode.
Figure 6:
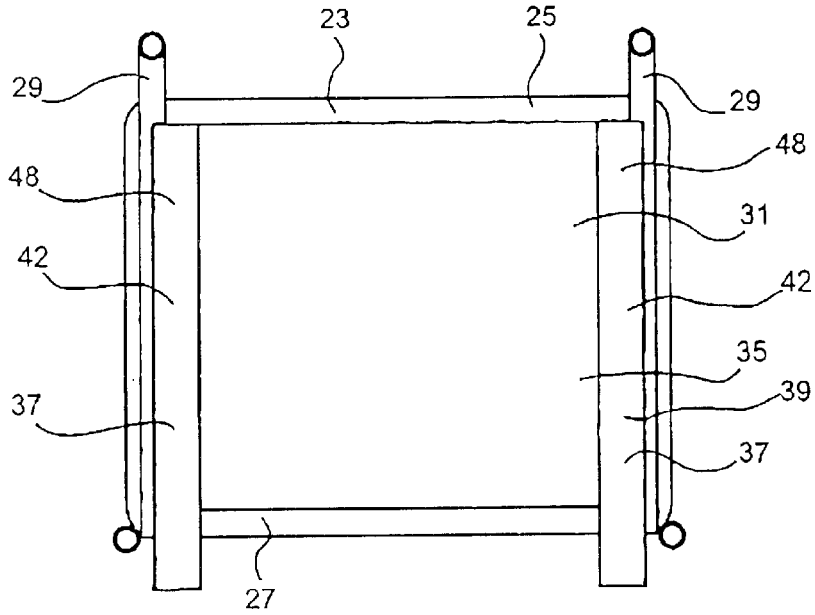
FIG. 6 is an underside view of the commode, without the receptacle in position.
Figure 7:
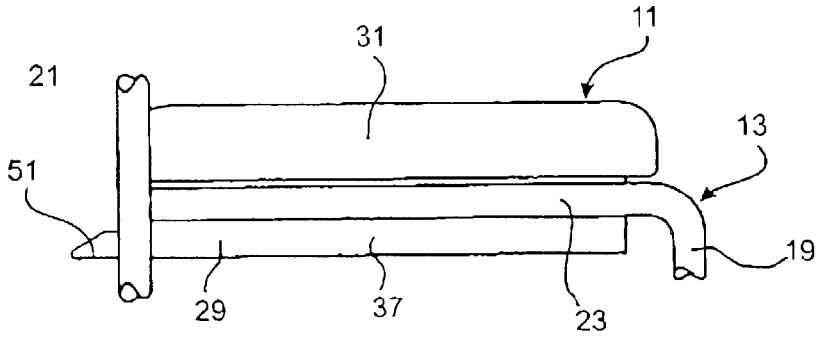
FIG. 7 is a side view of FIG. 5.

The commode frame 13 comprises tubular frame elements 17 assembled in a configuration which provides legs 19, a back-rest frame portion 21 and a base portion 23 upon which the seat 11 rests. The base 23 includes a front frame element 25, a rear frame element 27, and two spaced apart side frame elements 29, as best seen in FIG. 3 of the drawings.

The seat 11 includes a seat body 31 having a padded upper side 33 and an underside 35. The underside 35 is adapted to bear on the base 23 of the commode frame 13.

A pair of spaced apart elongate members 37 are provided on the underside 35 of the seat body 31 and are adapted to co-operatively engage the side frame elements 29 of the commode frame 13 for removably attaching the commode seat 11 to the commode frame 13.

The elongate members 37 also define rails 39 adapted to slidingly receive and releasably support the receptacle 15 beneath the commode seat 11, as will be explained in more detail later.

The elongate members 37 are resilient so as to provide a releasable snap engagement with the side frame elements 29, as will also be described in more detail later.

Each elongate member 37 comprises a first portion 41 and a second portion 42. The first portion 41 extends downwardly from the underside 35 of the seat body 31 for engagement against the respective frame element 29 of the commode frame 13, and the second portion 42 extends laterally of the first portion to define the respective rail 39.

Each first portion 41 is configured to conform to the profile of the respective commode frame element 29 to which it is adapted for engagement. In this embodiment, the commode frame elements 29 are of circular cross-section and so each first portion 41 incorporates a concave section 45 to conform to the circular profile of the commode frame element 29. Each first portion 41 also includes a lower section 47 which depends from the concave section 45 and which merges with the second portion 42.

The second portion 42 comprises an inturned lip 48 at the bottom of the lower section 47 to define the rail 39.

Figure 8:
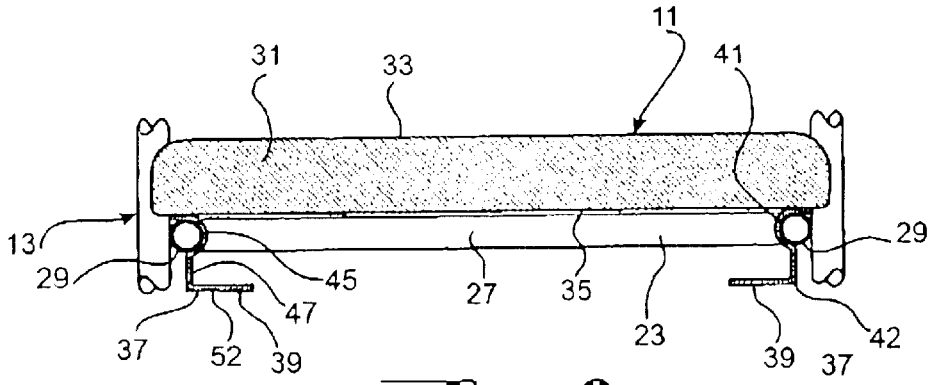
FIG. 8 is a cross-sectional view on line 8—8 of FIG. 5.
Figure 9:
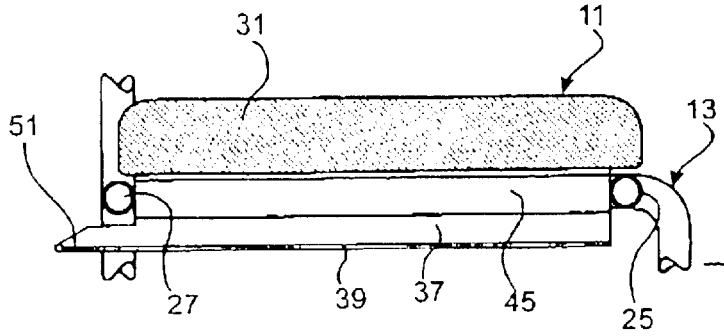
FIG. 9 is a cross-sectional view on line 9—9 of FIG. 5.
Figure 10:
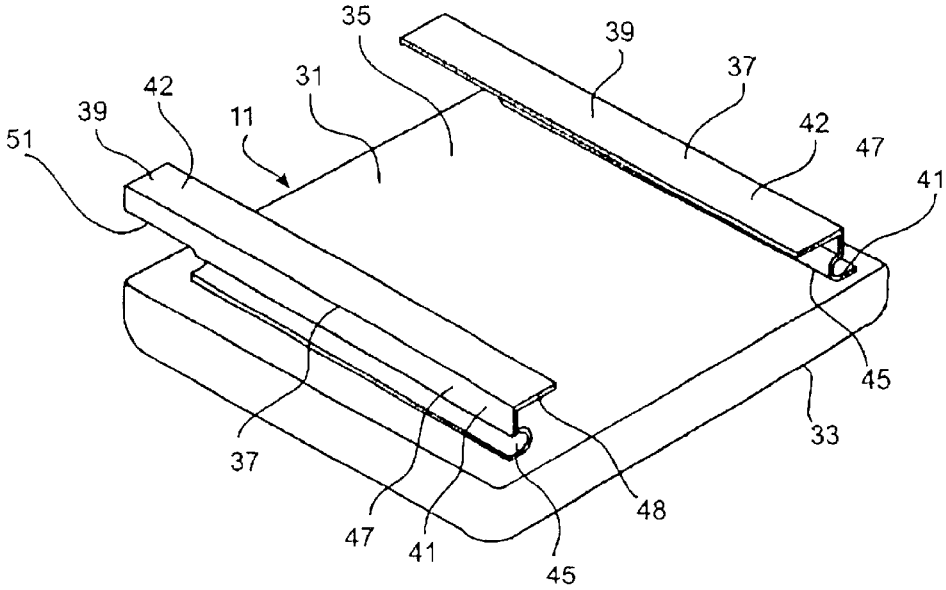
FIG. 10 is a perspective view of the underside of the commode seat viewed from the front end thereof.
Figure 11:
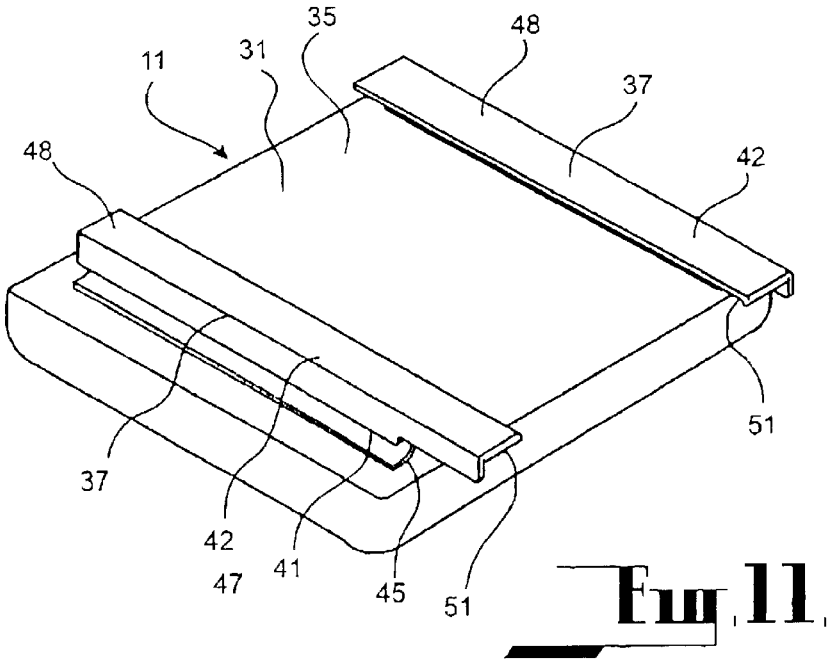
FIG. 11 is a perspective view of the underside of the commode seat viewed from the rear end thereof.
Figure 13:
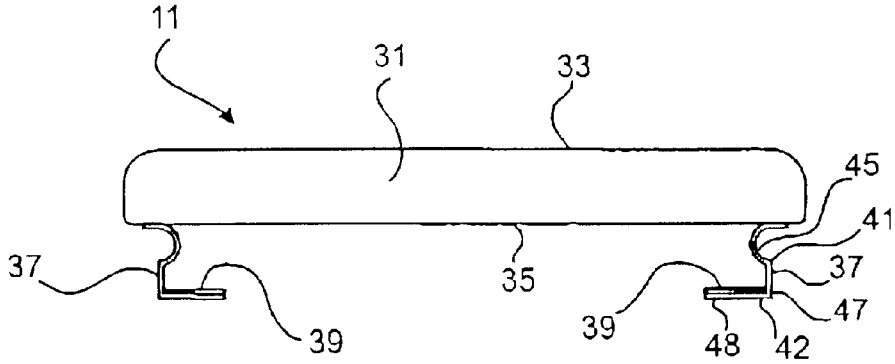
FIG. 13 is a front elevational view of the commode seat.

The elongate members 37 are spaced apart a distance determined by the spacing between the two side frame elements 29 of the commode frame 13, with the spacing between the elongate members 37 being such that the first portions 41 thereof can be resiliently deflected inwardly to allow the elongate members to be positioned between the commode frame elements 29 and upon subsequent release to snap into engagement with the side frame elements 29 by virtue of the concave sections 45 locating on the side frame elements 29, as shown in FIG. 8 of the drawings. In this way, the elongate members 37 securely attach the seat body 31 to the base 23 of the commode frame 13. In order to remove the commode seat 11 from the commode frame 13, it is merely necessary to deflect the first portions 41 inwardly towards each other so as to move the concave sections 45 out of engagement with the commode frame elements 29, thereby allowing the seat body 31 to be lifted away from the base 23 of the commode frame 13.

The second portion 42 of each elongate member 37 extends beyond the first portion 41 at the end of the elongate member corresponding to the rear of the seat body 31 to define a locating portion 51, the purpose of which will be explained later. The locating portion 51 terminates with an upstanding lip 52.

Figure 12:
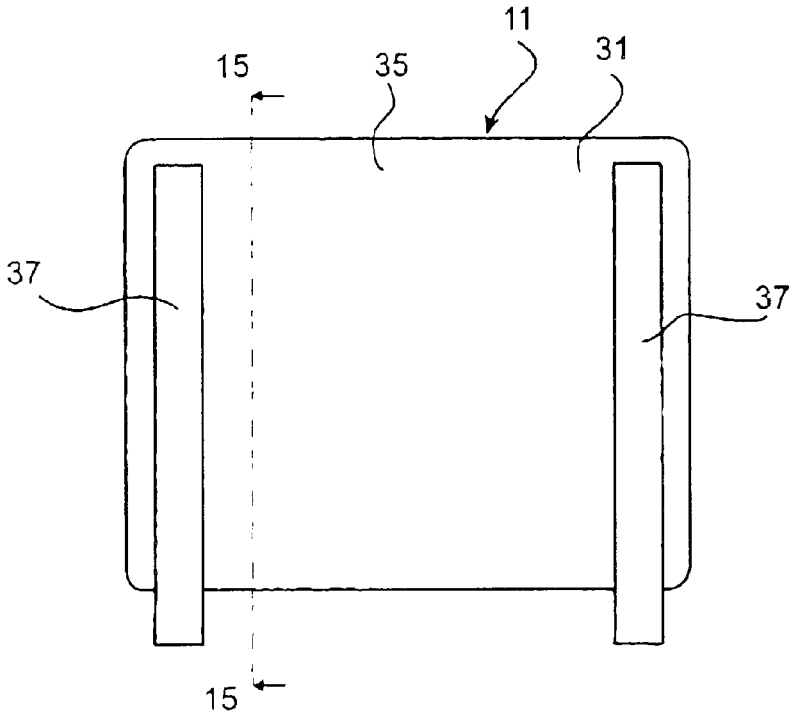
FIG. 12 is an underside plan view of the commode seat.
Figure 14:
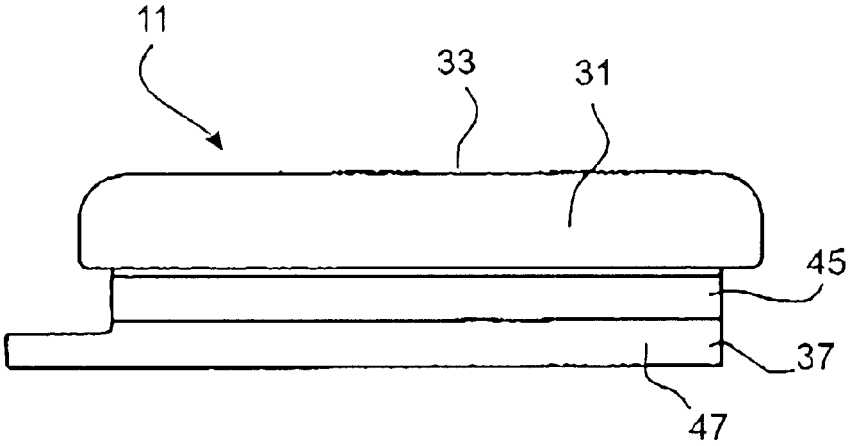
FIG. 14 is a side elevational view of the commode seat.
Figure 15:
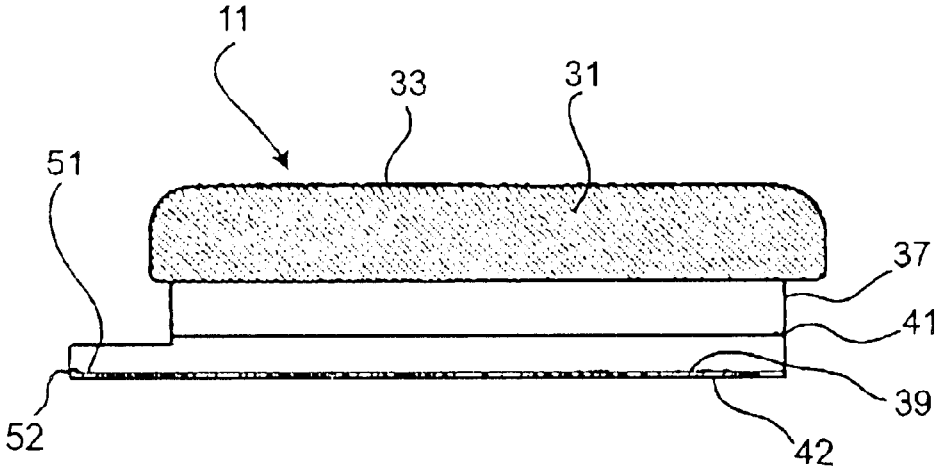
FIG. 15 is a cross-sectional view on line 15—15 of FIG. 12.

Each elongate member 37 is positioned inwardly of the sides of the seat body 31 (as best seen in FIG. 12 of the drawings) so as to provide clearance space to accommodate the commode frame elements 29 and thus allow the seat body 31 to overhang the base 23 at the sides thereof. Additionally, the elongate members 37 are set inwardly from the front edge of the seat body 31 (as best seen in FIG. 12 of the drawings) so as to provide a clearance space for the front frame element 25 and thereby allow the seat body 31 to overhang the front of the base 23. Further, concave section 45 of the first portion 41 of each elongate member 37 terminates inwardly of the rear edge of the seat body 31 (as best seen in FIGS. 14 and 15) to provide a clearance space to accommodate the rear frame element 27 and thereby allow the seat body 31 to overhang the base 23 at the rear thereof. However, the lower section 47 of the first portion 41 and also the second portion 42 extend outwardly beyond the rear edge of the seat body 31 (also as best seen in FIGS. 14 and 15) to expose the locating portions 51 for convenient access.

The receptacle 15 is in the form of a basket 55 assembled from elongate elements 57. The elongate elements 57 include a rectangular outer frame element 59, and a further frame element 61 configured as a handle 63. The rectangular outer frame element 59 includes a front frame section 65, a rear frame section 67 and two side frame sections 69.

The basket 55 is adapted to be slidingly received on and supported by the rails 39. Specifically, each side frame section 69 and the adjacent ends of the front and rear frame sections 65, 67 locate on a respective one of the rails 39.

The insertion of the basket 55 onto, and the removal of the basket from, the rails 39 is facilitated by the locating portions 51 which extend beyond the rear of the seat body 31. Because the locating portions 51 are exposed, the front frame section 65 of the basket 55 can be readily placed on the locating portions prior to the basket 55 being slid along the rails 39 into its position underneath the seat 11. Additionally, on withdrawal of the basket, the front frame section 65 can rest on the locating portion 51 at the final stage of the removal process, so allowing the basket to be simply lifted upwardly from the locating portions 51.

The ability to rest the basket 55 on the locating portions 51 of the rails 37 when inserting the basket into position on the commode 10, and also when withdrawing it from the commode, ensures that the basket 55 can be handled conveniently and easily. This arrangement also ensures that the front frame section 65 is correctly aligned with the rails 39 prior to the basket 55 being moved along the rails into its final position below the seat 11.

The upstanding lip 52 at the outer end of the locating portion 51 provides a stop to inhibit unintentional withdrawal of the basket 55 from beneath the seat 11.

In the embodiment, the receptacle 15 would typically be used for storage purposes. However, where the commode 10 is to be used as a toilet, the receptacle 55 would be used to support an appropriate bowl or pan. Alternatively, the receptacle 55 could itself be configured as a bowl or pan. In either case, the seat body 31 would incorporate an opening as is conventional practice with commodes used as toilets.

From the foregoing, it is evident that the present invention provides a simple yet highly effective arrangement for removably attaching a commode seat to a commode frame, as well as providing means for removably supporting a receptacle below the commode seat.

Improvements and modifications may be incorporated without departing from the scope of the invention.

Throughout the specification, unless the context requires otherwise, the word "comprise" or variations such as "comprises" or "comprising", will be understood to imply the inclusion of a stated integer or group of integers but not the exclusion of any other integer or group of integers.

What is claimed is:

1. A commode seat for removable attachment to a commode frame, the commode seat comprising:

a seat body having an underside adapted to bear on the commode frame and a pair of spaced apart elongate members on the underside, the pair of spaced apart elongate members being adapted to co-operatively engage two spaced apart frame elements of the commode frame for detachably attaching the commode seat to the commode frame, the elongate members also defining rails adapted to slidingly receive and releasably support a receptacle beneath the seat, the rails each having a locating portion at one end section thereof extending beyond said frame elements upon which a leading portion of the receptacle can be located prior to the receptacle being moved along the rails.

2. The commode seat according to claim 1 wherein the locating portion has an upstanding lip at the outer end thereof.

3. The commode seat according to claim 1 wherein at least one elongate member is resilient to provide a releasable snap engagement with the respective commode frame element.

4. The commode seat according to claim 3 wherein the elongate members are resilient.

5. A commode having a commode seat according to claim 1.

6. A commode seat for removable attachment to a commode frame, the commode seat comprising:

a seat body having an underside adapted to bear on the commode frame and a pair of spaced apart elongate members on the underside, the pair of spaced apart elongate members being adapted to co-operatively engage two spaced apart frame elements of the commode frame for detachably attaching the commode seat to the commode frame, the elongate members also defining rails adapted to slidingly receive and releasably support a receptacle beneath the seat, each elongate member includes a first portion and a second portion, the first portion extending downwardly from the underside of the seat for engagement against the respective frame element of the commode frame, and the second portion extending laterally to define the respective rail, and the second portion of each elongate member extends beyond said frame elements the concave section at one end of the elongate member to define a locating portion at the end of the rail upon which a leading portion of the receptacle can be located prior to the receptacle being moved along the rails.

7. The commode seat according to claim 6 wherein each first portion is configured to conform to the profile of the respective commode frame element to which it is adapted for engagement.

8. The commode seat according to claim 7 wherein the first portion comprises a concave section.

9. The commode seat according to claim 6 wherein the second portions extend laterally in an inward direction towards each other.

* * * * *